US010252284B2

(12) United States Patent
Arminak

(10) Patent No.: US 10,252,284 B2
(45) Date of Patent: Apr. 9, 2019

(54) FOAM PUMP ACTUATOR WITH FOLDING NOZZLE SUITABLE FOR E-COMMERCE

(71) Applicant: Armin Arminak, Pasadena, CA (US)

(72) Inventor: Armin Arminak, Pasadena, CA (US)

( * ) Notice: Subject to any disclaimer, the term of this patent is extended or adjusted under 35 U.S.C. 154(b) by 0 days.

(21) Appl. No.: 16/150,147

(22) Filed: Oct. 2, 2018

(65) Prior Publication Data

US 2019/0030556 A1 Jan. 31, 2019

Related U.S. Application Data

(63) Continuation-in-part of application No. 15/946,436, filed on Apr. 5, 2018.

(60) Provisional application No. 62/532,940, filed on Jul. 14, 2017, provisional application No. 62/678,814, filed on May 31, 2018.

(51) Int. Cl.
*B05B 11/00* (2006.01)

(52) U.S. Cl.
CPC ..... *B05B 11/0091* (2013.01); *B05B 11/3019* (2013.01); *B05B 11/3054* (2013.01); *B05B 11/3067* (2013.01); *B05B 11/3097* (2013.01)

(58) Field of Classification Search
CPC ..... B05C 11/0091; B05C 11/3019; B05C 11/3054; B05C 11/3067; B05C 11/3097; B05B 11/0091; B05B 11/3019; B05B 11/3054; B05B 11/3067; B05B 11/3097
See application file for complete search history.

(56) References Cited

U.S. PATENT DOCUMENTS 3,874,562 A 4/1975 Hazard
3,884,392 A * 5/1975 Hazard ..... B65D 47/305 222/153.14
3,907,174 A 9/1975 Steiman
(Continued)

FOREIGN PATENT DOCUMENTS

GB 1466436 3/1977
JP 08038959 2/1996
(Continued)

OTHER PUBLICATIONS

USPTO, International Search Report and Written Opinion issued in related International Patent Application No. PCT/US2018/029632 dated Jul. 6, 2018, 16 pages.
(Continued)

*Primary Examiner* — Frederick C Nicolas
(74) *Attorney, Agent, or Firm* — Cislo & Thomas, LLP

(57) ABSTRACT

An actuator for a hand operated foam dispensing pump that utilizes a folding nozzle is presented. The folding nozzle of the actuator is configured so as to lock the actuator in place and prevent operation of the pump when the nozzle is folded. The actuator substantially reduces pump closure loosening (back-off) and nozzle breakage during shipping of a filled product by eliminating trigger handles or other conventional nozzle types which protrude from the side of the actuator. As such, the new actuator is particularly well-suited for use in e-commerce where the shipping of unboxed products is becoming increasingly common. The actuator is configured such that actuator depression (actuation) cannot occur when the folding nozzle is in a folded position.

20 Claims, 19 Drawing Sheets

(56) References Cited

U.S. PATENT DOCUMENTS

| | | | | |
|---|---|---|---|---|
| 4,320,859 | A * | 3/1982 | Shy | B67D 1/0425 222/401 |
| 4,479,589 | A | 10/1984 | Ford | |
| 4,819,832 | A * | 4/1989 | Lawson | B05B 11/0005 222/153.13 |
| 5,143,237 | A | 9/1992 | Lindsey et al. | |
| 5,875,936 | A | 3/1999 | Turbett et al. | |
| 6,334,549 | B1 | 1/2002 | Fernandez et al. | |
| 7,249,692 | B2 | 7/2007 | Walters et al. | |
| 8,439,230 | B2 * | 5/2013 | Hagen | B05B 11/3001 222/153.13 |
| 9,010,581 | B2 * | 4/2015 | Presche | B05B 11/0032 222/153.13 |
| 9,393,583 | B2 * | 7/2016 | Tu | B05B 1/267 |
| 9,565,978 | B2 * | 2/2017 | Hall | A47K 5/12 |
| 2010/0006606 | A1 | 1/2010 | Lee | |
| 2014/0239021 | A1 | 8/2014 | Xufeng | |
| 2017/0021376 | A1 | 1/2017 | Espinoza | |

FOREIGN PATENT DOCUMENTS

| | | |
|---|---|---|
| JP | 10101115 | 4/1998 |
| WO | 2017081594 | 5/2017 |
| WO | 2017140542 | 8/2017 |

OTHER PUBLICATIONS

USPTO, International Search Report and Written Opinion issued in related International Patent Application No. PCT/US 18/54935 dated Dec. 18, 2018, 11 pages.

* cited by examiner

FOAM PUMP ACTUATOR WITH FOLDING NOZZLE SUITABLE FOR E-COMMERCE

CROSS-REFERENCES TO RELATED APPLICATION

This application claims the benefit as a continuation-in-part of U.S. patent application Ser. No. 15/946,436, filed on Apr. 5, 2018, entitled "Hand Pump With Folding Nozzle," which claims benefit to United States Provisional Application Serial Ser. No. 62/532,940, filed Jul. 14, 2017 and entitled "A Hand Pump Actuator with Folding Nozzle Suitable for Ecommerce"; as well as claims the benefit of U.S. Provisional Application Ser. No. 62/678,814, filed May 31, 2018, entitled "A Hand Foam Pump Actuator with Folding Nozzle Suitable for Ecommerce", all of which are incorporated herein, in their entirety, by this reference.

BACKGROUND OF THE INVENTION

Field of the Invention

This invention relates to actuators for hand operated dispensing pumps and more particularly, to actuators for hand operated dispensing pumps that foam the fluid being dispensed without the use of aerosol propellants.

Background Art

Hand operated foam pump dispensers are well known in the personal care industry for dispensing foam products. Pumps of this type require that the liquid and air be mixed under pressure in a dispenser bottle. Hand operated foam pumps commonly include a liquid pump chamber and an air pump chamber. Typically, a piston moves between the charge and discharge positions in the air pump chamber and the liquid pump chamber to draw air or liquid into the respective chambers and force the air or the liquid from the chambers into a mixing region where the mixed air and liquid produce foam and the foamed products subsequently exit the nozzle of the actuator.

Prior art hand operated foam pumps are typically operated by means of trigger action requiring a trigger handle or linear action requiring a push button actuator, Both types of mechanisms feature fixed nozzles that protrude from the sides of the actuators. The protruding fixed nozzle or trigger of prior art hand operated foam pump actuators requires that they be packaged so as to prevent nozzle breakage during shipping. This limitation makes prior art hand operated foam pumps generally unsuitable for use in e-commerce where products are often shipped without packaging to prevent breakage and increasingly commonly, without any packaging at all.

What is needed therefore, to meet the demands of e-commerce, is an actuator assembly with a nozzle design that does not protrude from the actuator and therefore allows for filled products to be shipped with little or no packaging. It would be further desirable if the actuator were configured such that it could easily be locked into place to prevent actuation during shipping.

SUMMARY OF THE INVENTION

The present invention provides a new design for an actuator assembly for a hand operated foam pump. The new actuator assembly comprises an actuator, a folding nozzle and a pump closure. The folding nozzle of the new actuator assembly eliminates the protrusion of a conventional nozzle or trigger handle and thereby helps to prevent the closure of the actuator assembly from loosening and unlocking during shipping. The folding nozzle of the actuator assembly of the present invention is configured so as to lock the actuator in place and prevent operation of the hand pump when the nozzle is folded. The folding nozzle of the actuator assembly substantially reduces pump closure loosening, i.e. the tendency of the closure to loosen or separate (i.e. back-off) from the dispenser bottle due to vibration during shipping. Likewise, the folding nozzle substantially reduces the likelihood of parts breakage during shipping of a filled product, again by eliminating trigger handles or other conventional nozzle types which protrude from the side of the actuator.

The ability of the actuator assembly of the present invention to resist loosening and unlocking during shipping is further enhanced by configuring the folding nozzle such that it is locked to the actuator via snap tabs when in the folded position. The folding nozzle is unfolded after the package is delivered and ready for use. The ability of the actuator assembly of the present invention to resist loosening and unlocking during shipping is further enhanced by providing an actuator assembly that is free of any sharp edges, surface discontinuities or protrusions that may catch on other containers or packaging during shipping.

The above and other advantages of the hand pump of the present invention will be described in more detail below.

DETAILED DESCRIPTION OF THE PREFERRED EMBODIMENTS

Figure 1:
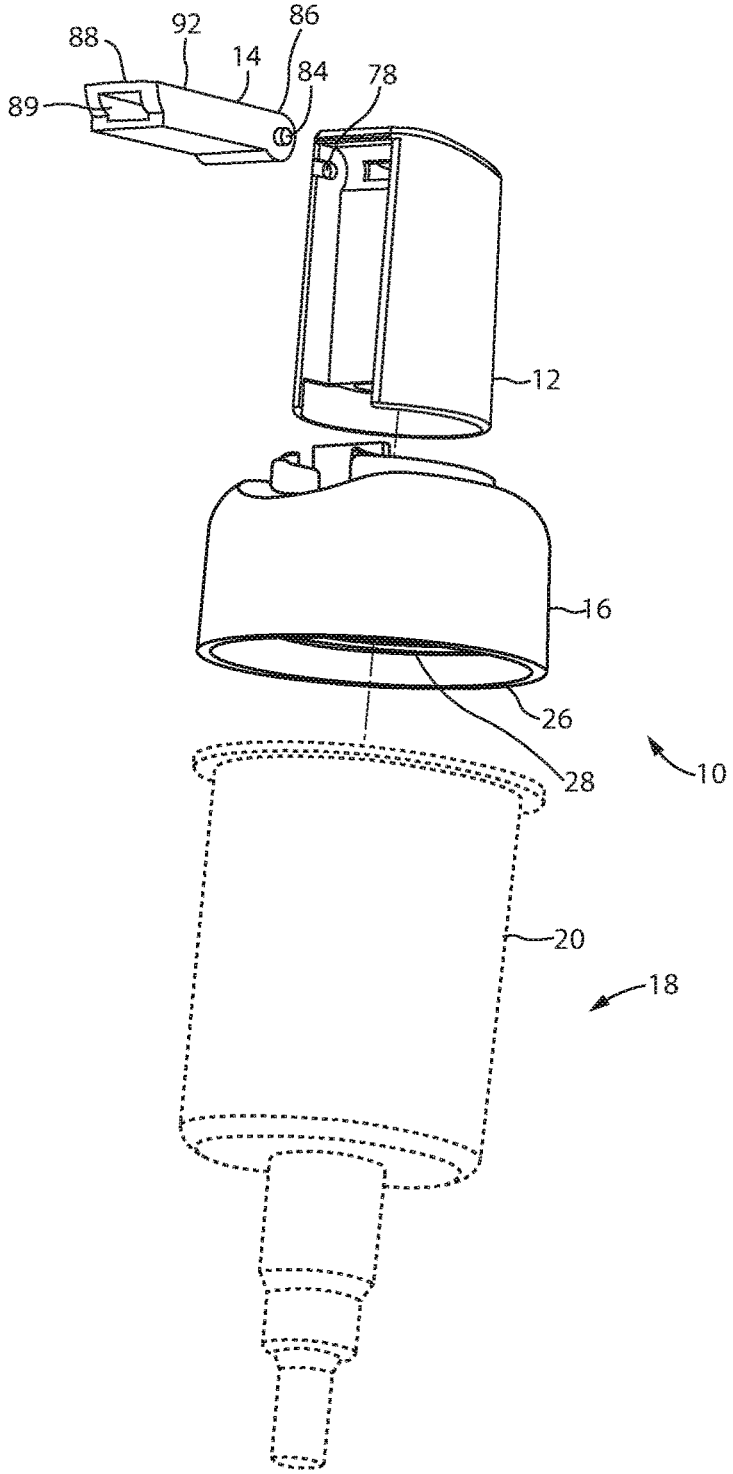
FIG. 1 is an exploded, perspective view of the actuator assembly of the present invention, showing the nozzle in an unfolded position.

The present invention will now be described more fully hereinafter with reference to the accompanying drawings, in which preferred embodiments of the invention are shown. The invention may, however, be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

First Embodiment

Referring to FIGS. 1-7, the actuator assembly 10 of the present invention comprises an actuator 12, a folding nozzle 14 and a pump closure 16. The actuator assembly 10 is mounted on a commonly available prior art, hand operated foam pump 18, typically by means of a snap fit between the pump closure 16 and a pump body 20 of the hand operated foam pump 18. One such suitable prior art foam pump for use with the actuator assembly 10 of the present invention is Pump No. F2 (http://www.albea-group.com/en/products/product-catalog/f2.html), manufactured by Albéa Group, 1,av du Général de Gaulle/ZAC des Barbanniers, Le Signac/92635 Gennevilliers Cedex, France.

Figure 2:
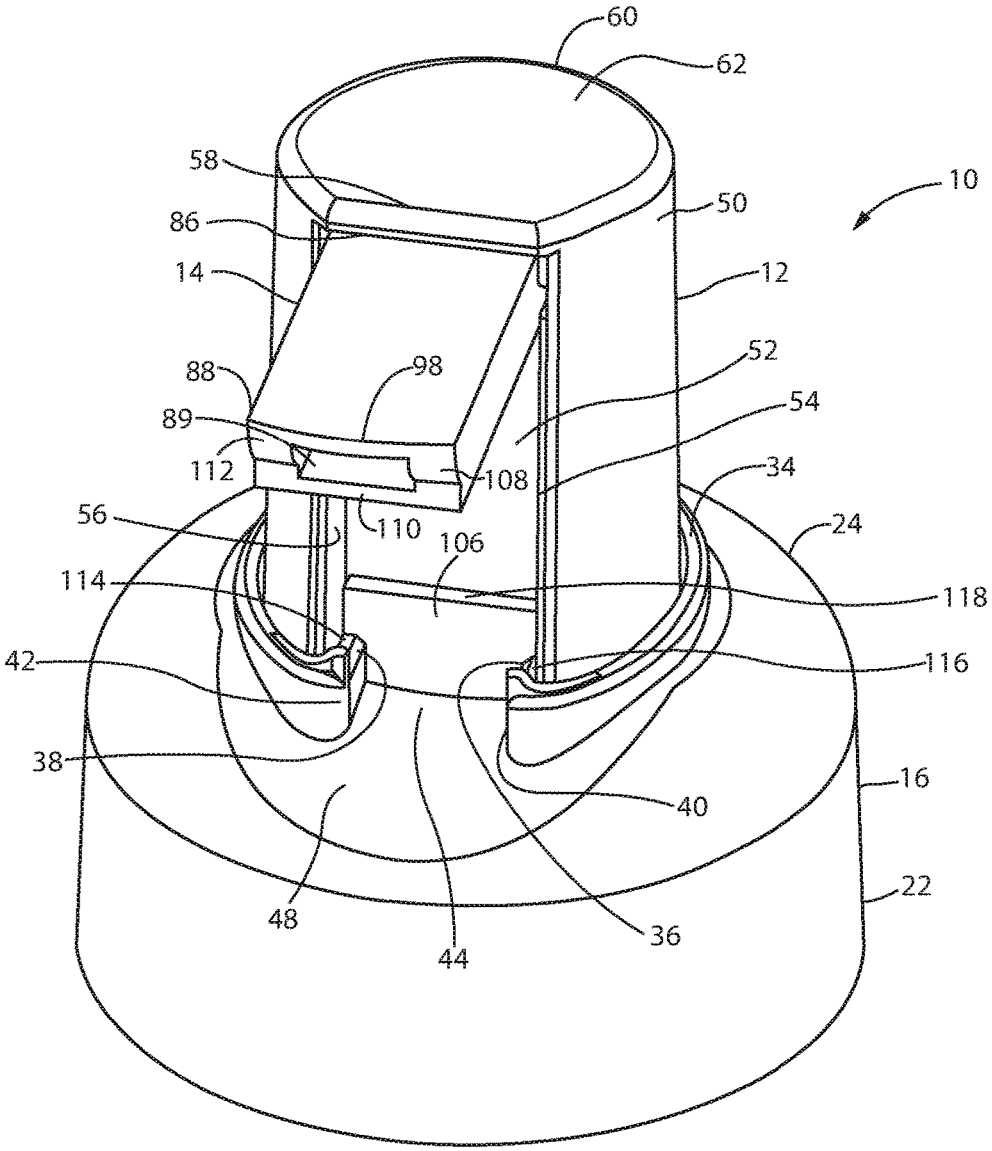
FIG. 2 is a front perspective view of the actuator assembly of FIG. 1, showing the actuator in its normally extended position with the nozzle in an unfolded position.
Figure 3:
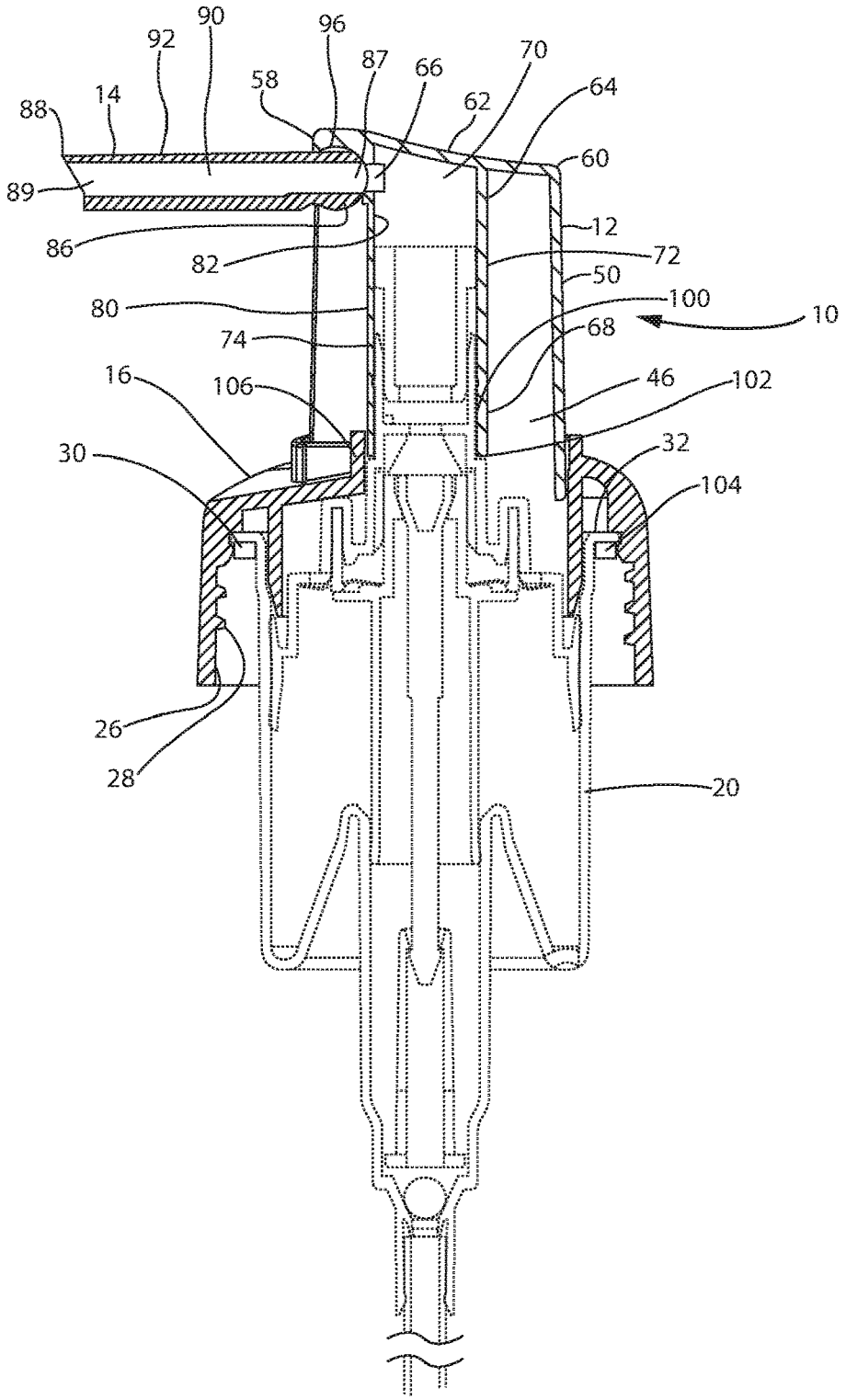
FIG. 3 is a cross sectional view of the actuator of FIG. 1, showing the actuator in its normally extended position with the nozzle in an unfolded position.

With continued reference to FIGS. 1-7, and particular reference to FIGS. 2 and 3, the pump closure 16 of the actuator assembly 10 is an injection molded part having a generally cylindrical body 22 and a generally dome shaped top 24. As shown in FIG. 2 and FIGS. 3-5, the pump closure 16 is hollow having a generally cylindrical interior wall 26, which features a plurality of screw threads 28. The plurality of screw threads 28 allow the pump closure 16 to be screwed onto a dispenser bottle (not shown). The pump closure includes a circular groove 30 which engages a circular lip 32 on the pump body 20, i.e. the pump body 20 is attached to the closure 16 via a snap-fit between the circular lip 32 of the pump body 20 and the circular groove 30 of the closure 16.

With particular reference to FIG. 2, the generally dome shaped top 24 of the pump closure 16 includes a raised retaining wall 34 having a generally oval shaped perimeter wherein the retaining wall 34 has an open section 44 which is bounded at one end of the retaining wall 34 by a first retaining member 36 and at another end of the retaining wall 34 by a second retaining member 38. At the junction of the retaining wall 34 and the first retaining member 36 is formed a first snap element 40 and at the junction between the retaining wall 34 and the second retaining element 38 is a second snap element 42.

As best shown in FIGS. 2-5, a region of the dome shaped top 24 of the closure 16, interior of the retaining wall 34 is cutaway to form a generally oval shaped opening 46 which corresponds to a generally, oval shaped exterior wall 50 of the actuator 12. Received within the opening 46 is the actuator 12. The generally dome shaped top 24 of the pump closure 16 further includes a recessed portion 48, which serves to allow a user to more easily release the folding nozzle 14, when the nozzle is in the folded position.

With continued reference to FIGS. 1-7, the actuator 12 is also an injection molded component with a hollow interior. The actuator 12 has an exterior wall 50 having a generally oval shaped perimeter with a recessed portion 52 at a front end. The recessed portion 52 is bounded at one end by a first engaging wall 54 and a second engaging wall 56 and by an abutment wall 106 which extends between first engaging wall 54 and the second engaging wall 56. The recessed portion 52 is configured to receive the nozzle 12 when the nozzle is in the folded position.

The actuator is configured such that it may be slidably received within the opening 46 of the pump closure 16, wherein the exterior wall 50 of the actuator slides within the retaining wall 34 of the pump closure 16 and the first engaging wall 54 of the actuator 16 slidably engages the first retaining member 36 of the pump closure 16; and wherein the second engaging wall 56 of the actuator 12 slidably engages the second retaining wall 38 of the pump closure 16.

The actuator 12 also features a top portion 62 having a front edge portion 58 and a rear edge portion 60, where the top portion 62 slopes downwardly from the front edge portion 58 to the rear edge portion 60. (Best shown in FIGS. 3-5.) The sloping top portion 62 assists a user in depressing the actuator with a finger or thumb. Formed within the actuator 12 is a generally, centrally located vertical tube 64, having a wall 72. The wall 72 has a cylindrical interior surface 82. A portion of the wall 72 forms a face 80 of the recessed portion 52. The wall 72 is of sufficient thickness in this area such that the face 80 of the recessed portion 52 is a generally rectangular flat surface. The wall 72 is open at a lower inlet end 68, radially closed at an upper end 70, and has a rectangular opening 66 disposed adjacent the upper end 70 of the tube 64, wherein the rectangular opening 66 extends through the face 80 of the recessed portion 52 and the cylindrical interior surface 82 of the wall 72.

With reference to FIG. 1, the first side engagement wall 54 and the second side engagement wall 56 of the actuator 12 are each equipped with a dimple or small circular depression 78 adjacent the top edge 58 of the actuator 12. (See FIG. 1.) The dimples 78 engage with generally circular protrusions 84 located at an inlet end 86 of the nozzle 12. When assembled, the generally circular protrusions 84 of the nozzle 14 snap into the dimples 78 of the actuator 12. The inlet end 86 of the nozzle 14 is rounded so as to be rotatable within a matching rounded portion 96 of the actuator 14.

Figure 17:
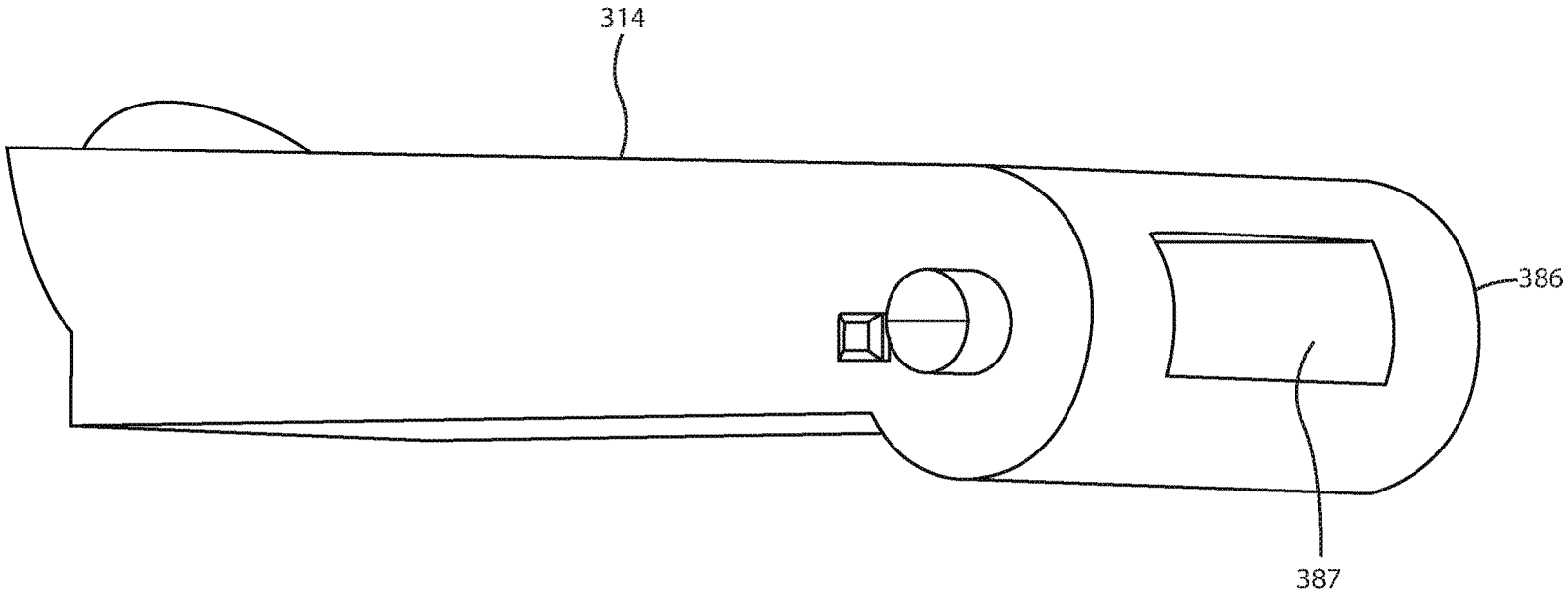
FIG. 17 is a front perspective view of an alternative embodiment of a nozzle for use with actuator assemblies of the present invention.
Figure 18:
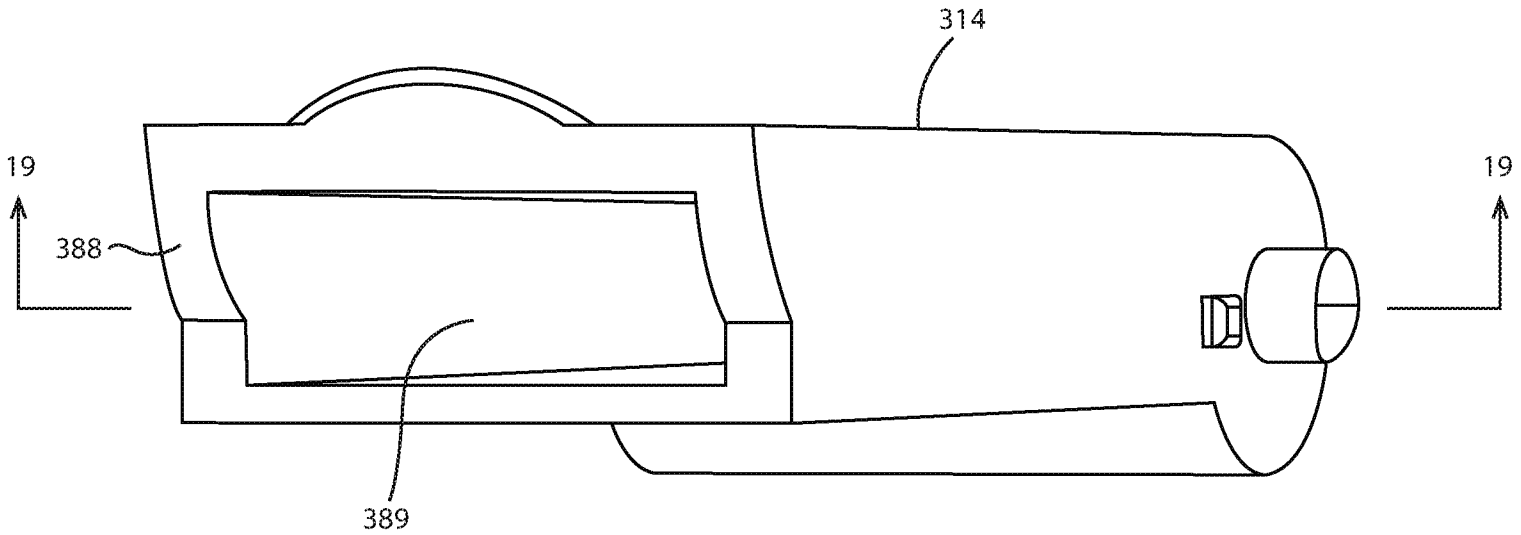
FIG. 18 is a rear perspective view of the nozzle of FIG. 18.
Figure 19:
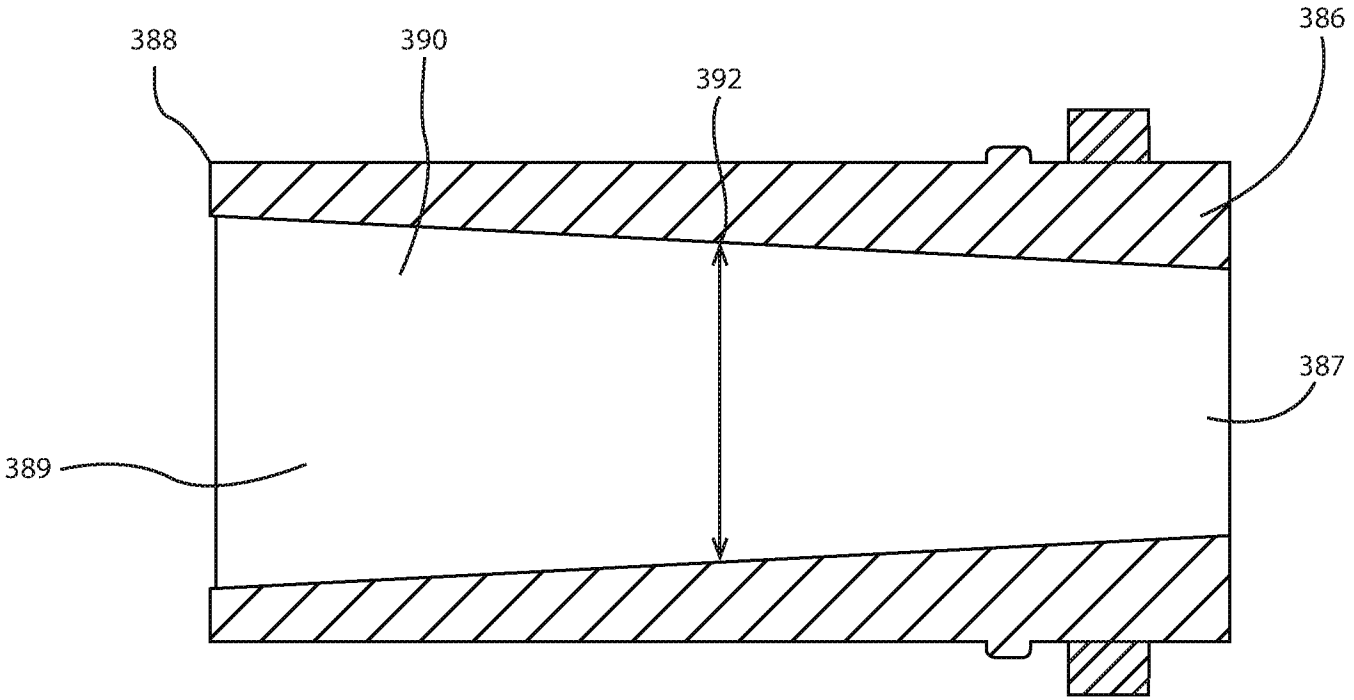
FIG. 19 is a cross-sectional view of the nozzle of FIG. 18 taken along the line 19-19 of FIG. 18.

With reference to FIGS. 1-7, the nozzle 14 of the actuator assembly 10 has a hollow, generally rectangular body 92, having the inlet end 86, an outlet end 88, and a flow passage 90 therebetween. The inlet end 86 has an inlet flow area 87 and the outlet end 88 has an outlet flow area 89. In one embodiment, the flow passage 90 has a constant, rectangular cross-section and, in this case, the inlet flow area 87 and the outlet flow area 89 are the same. The flow passage 90 may also have a circular or square cross-section and may be of other cross-sectional shapes if desired. In alternative embodiments, the flow passage 90 of the nozzle 14 may have a varying cross-section such that, for example, the outlet area 89 is larger than the inlet area 87. FIGS. 17-19 depict such an alternative embodiment.

With continued reference to FIGS. 1-7, the outlet end 88 of the nozzle 14 has a front face 98. When the nozzle 14 is in the folded position, the front face 98 engages the first and second snap elements 40 and 42 of the pump closure 16. When assembled to the actuator, the inlet end 86 of the nozzle 14 is in fluid communication with the rectangular opening 66 of the tube 64 of the actuator 12.

Figure 4:
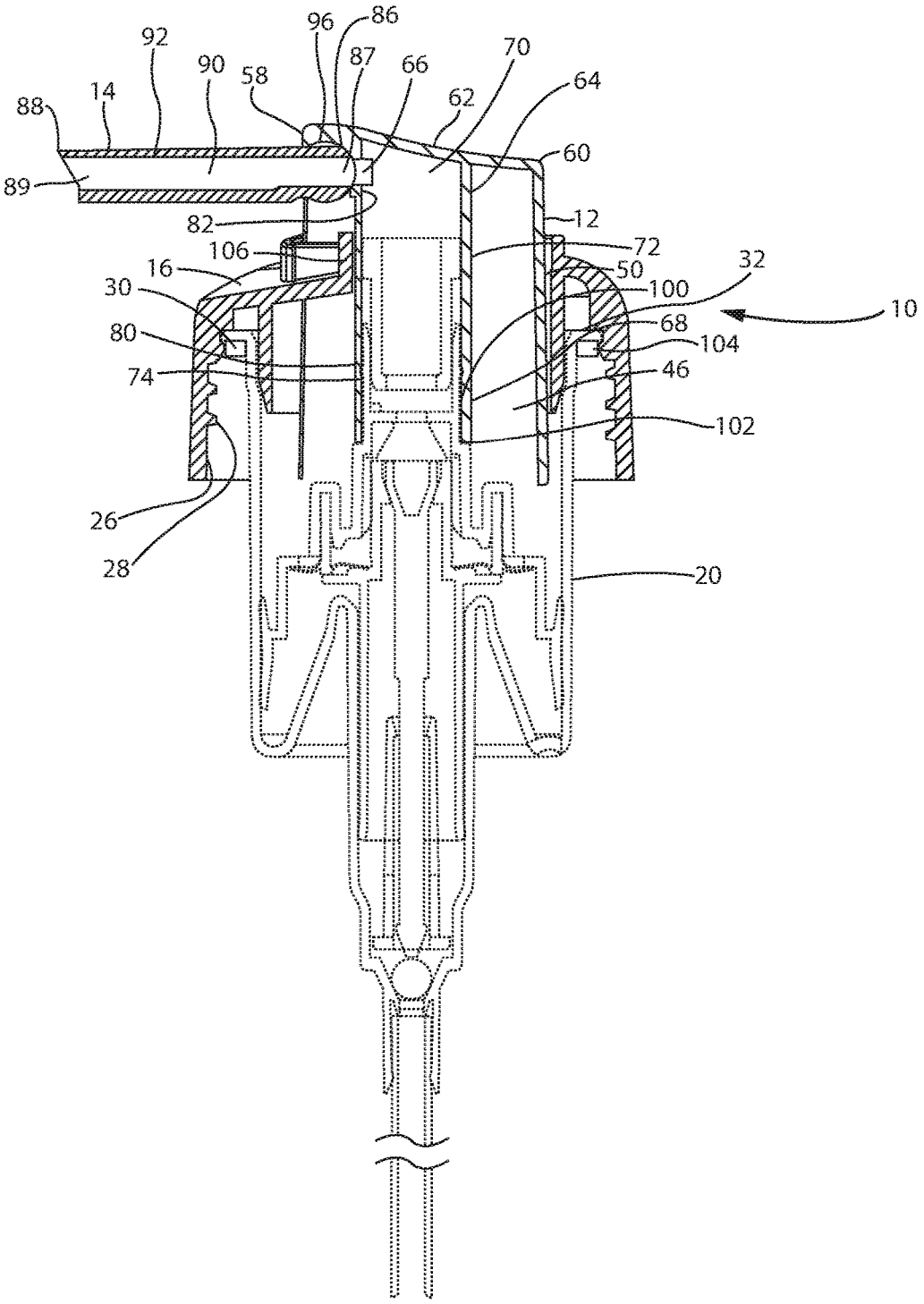
FIG. 4 is a cross sectional view of the actuator of FIG. 1, showing the actuator in its fully depressed position with the nozzle in an unfolded position.
Figure 5:
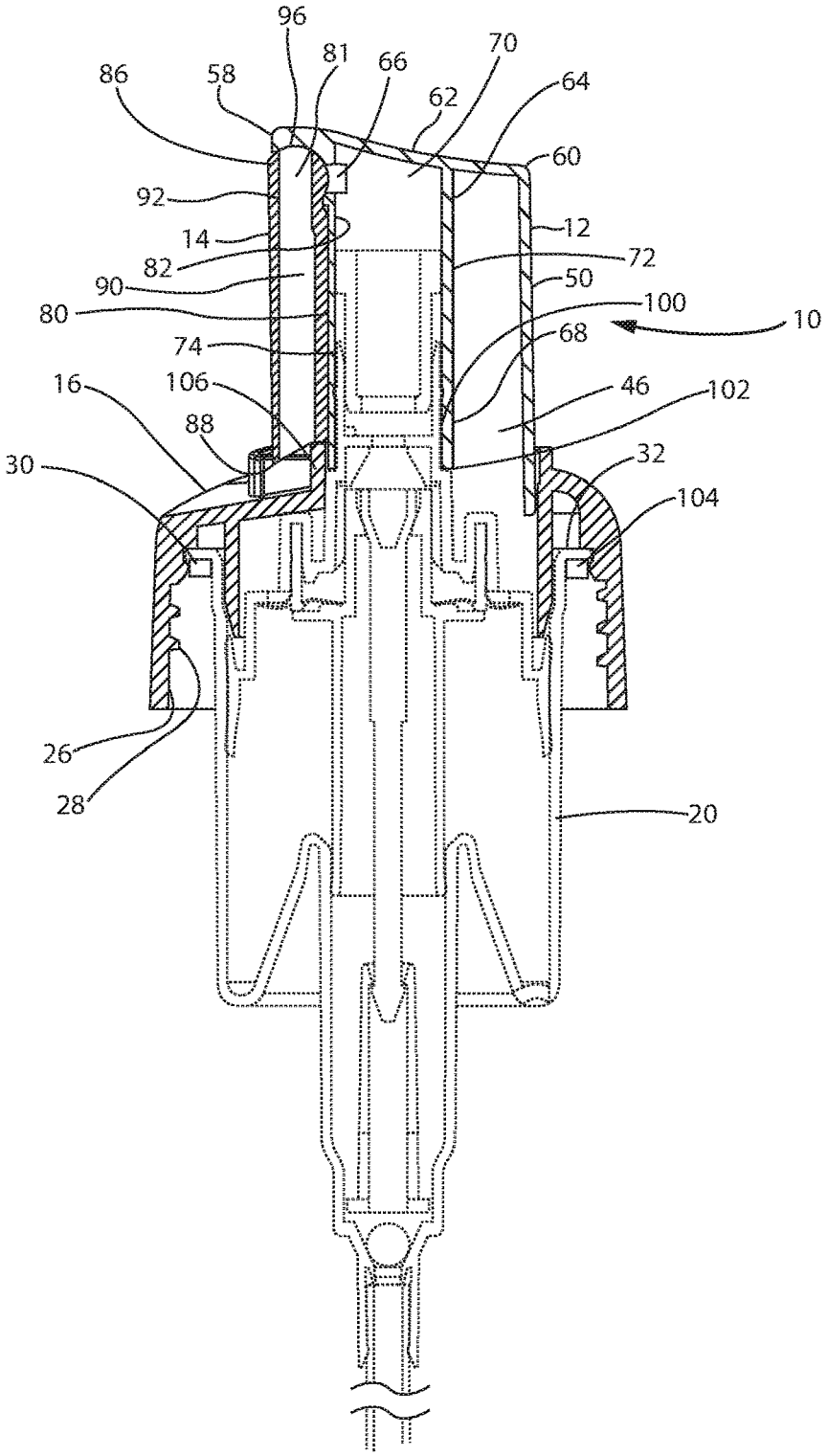
FIG. 5 is a cross sectional view of the actuator of FIG. 1, showing the actuator in its normally extended position with the nozzle in a folded position.
Figure 6:
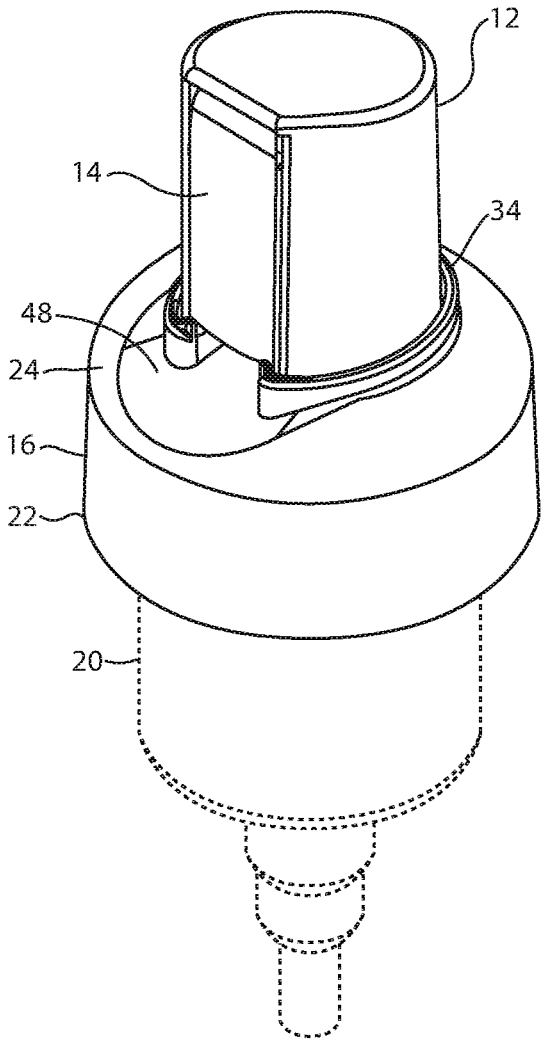
FIG. 6 is a second front perspective view of the actuator of FIG. 1, showing the actuator in its normally extended position with the nozzle in a folded position.
Figure 7:
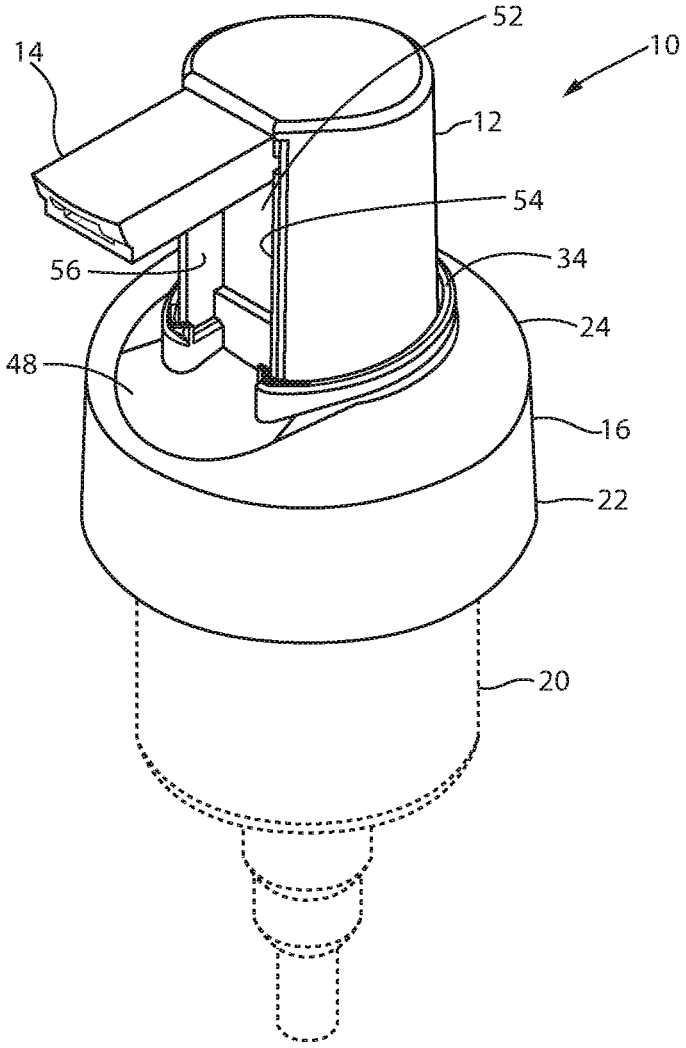
FIG. 7 is a front perspective view of the actuator of FIG. 1, showing the actuator in its normally extended position with the nozzle in an unfolded position.

With reference to FIGS. 3-5, the actuator assembly 10 is assembled and installed on a hand operated foam pump as follows. First, the generally circular protrusions 84 of the nozzle 14 snap into the dimples 78 of the actuator 12, The inlet end 86 of the nozzle 14 is rounded and fits within the rounded portion 96 of the actuator 14. The nozzle is foldable between an open position, (see FIG. 3), and a closed position (see FIG. 5.) In the closed position, the front face 98 of the nozzle 16 engages the first and second snap elements 40 and 42 of the pump closure 16.

Next, the actuator 12 is slid within the opening 46 of the pump closure 16. The actuator is configured such that the exterior wall 50 of the actuator slides within the retaining wall 34 of the pump closure 16. The first engaging wall 54 of the actuator 16 slidably engages the first retaining member 36 of the pump closure 16 and the second engaging wall 56 of the actuator 12 slidably engages the second retaining wall 38 of the pump closure 16.

Subsequently, a stem 100 of a prior art hand operated pump 18 such as Pump No. F2 (http://www.albea-group.com/en/products/product-catalog/f2.html) manufactured by Albéa Group, 1,av du Général de Gaulle/ZAC des Barbanniers, Le Signac/92635 Gennevilliers Cedex, France, is press fit into the inlet end 68 of the centrally located tube 64 of the actuator 12. The stem 100 of the prior art hand operated pump 18 will typically include a shoulder 102, The stem 100 is pressed into the centrally located tube of the actuator 14 until the centrally located tube 64 bottom outs on the shoulder 102 of the stem 100. Next, the pump closure 16 is snap fit over the circular lip 32 on the pump body 20, such that the circular lip 32 engages the circular groove 30 of the pump closure 16 and thereby secures the pump closure 16 to the pump body 20. Next, a gasket 104 is placed on the underside of the circular lip 32 of the pump body 20 and the hand pump 18 is inserted into a dispenser bottle (not shown), The dispenser bottle will typically include external threads and is secured to the pump closure 16 by means of mating internal screw threads 28 formed on the pump closure 16.

Typically, the pump actuator assembly 10 of the present invention, with the nozzle 14 in the closed position, will be shipped installed on a hand pump 18 and the resulting assembly attached to a dispenser bottle (not shown). This configuration is shown in FIG. 5. It should be noted that with the nozzle 14 folded and locked into place, i.e. the front face 98 of the nozzle 14 has engaged the first and second snap elements 40 and 42 of the pump closure 16, the actuator 12 cannot be depressed and thus the hand pump cannot be operated because first, second and third abutment faces or surfaces 108, 110 and 112, of the nozzle 14 (see FIG. 2), abut corresponding first, second and third abutment faces or surfaces 114, 116 and 118 on the pump closure 16 (see FIG. 2). This ensures against inadvertent operation of the hand pump during shipping.

During operation, the nozzle 14 is unfolded or opened. The actuator 12 may then be depressed to operate the hand pump 18, FIG. 4 shows the nozzle 12 in its fully depressed position. The amount of depression of the nozzle 12 is determined by the travel limits of the hand pump 18. The nozzle 14 and the centrally located tube 64 of the actuator 12 are in fluid communication and the centrally located tube 64 of the actuator 12 is in fluid communication with the hand pump 18 via the stem 100 of the hand pump which is in fluid communication with the contents of a dispenser bottle.

An actuator assembly 10 comprising a pump closure 16, an actuator 12 and folding nozzle 14, has been presented. The new actuator assembly 10 eliminates the protrusion created by conventional nozzles or trigger handles of prior art actuators. The folding nozzle 14 of the new actuator assembly 10 helps to prevent the closure 16 of the actuator assembly 10 from loosening and unlocking during shipping. The folding nozzle 14 of the actuator assembly 10 of the present invention is configured so as to lock the actuator 12 in place and prevent operation of a hand pump when the nozzle 14 is folded. The folding nozzle 14 also substantially reduces the likelihood of parts breakage during shipping of a filled product, again by eliminating trigger handles or other conventional nozzle types which protrude from the side of the actuator.

The ability of the actuator assembly 10 of the present invention to resist loosening and unlocking during shipping is further enhanced by providing an actuator assembly 10 that is free of any sharp edges, surface discontinuities or protrusions that may catch on other containers or packaging during shipping.

Second Embodiment

Referring now to FIGS. 8-16, a second embodiment 210 of the actuator assembly of the present invention is presented. The second embodiment 210 differs from the first embodiment 10 in the manner in which the nozzle locks to the closure. In all other respects the first and second embodiments function the same and the individual components parts, i.e. the nozzle, closure and actuator, have tile same features.

Referring to FIGS. 8-16, the second embodiment of the actuator assembly 210 of the present invention comprises an actuator 212, a folding nozzle 214 and a pump closure 216. The actuator assembly 210 is mounted on a commonly available prior art, hand operated foam pump 218, typically by means of a snap fit between the pump closure 216 and a pump body 220 of the hand operated foam pump 218. One such suitable prior art foam pump for use with the actuator assembly 10 of the present invention is Pump No. F2 (http://www.albea-group.com/en/products/product-catalog/f2.html), manufactured by Albéa Group, 1,av du Général de Gaulle/ZAC des Barbanniers, Le Signac/92635 Gennevilliers Cedex, France.

Figure 8:
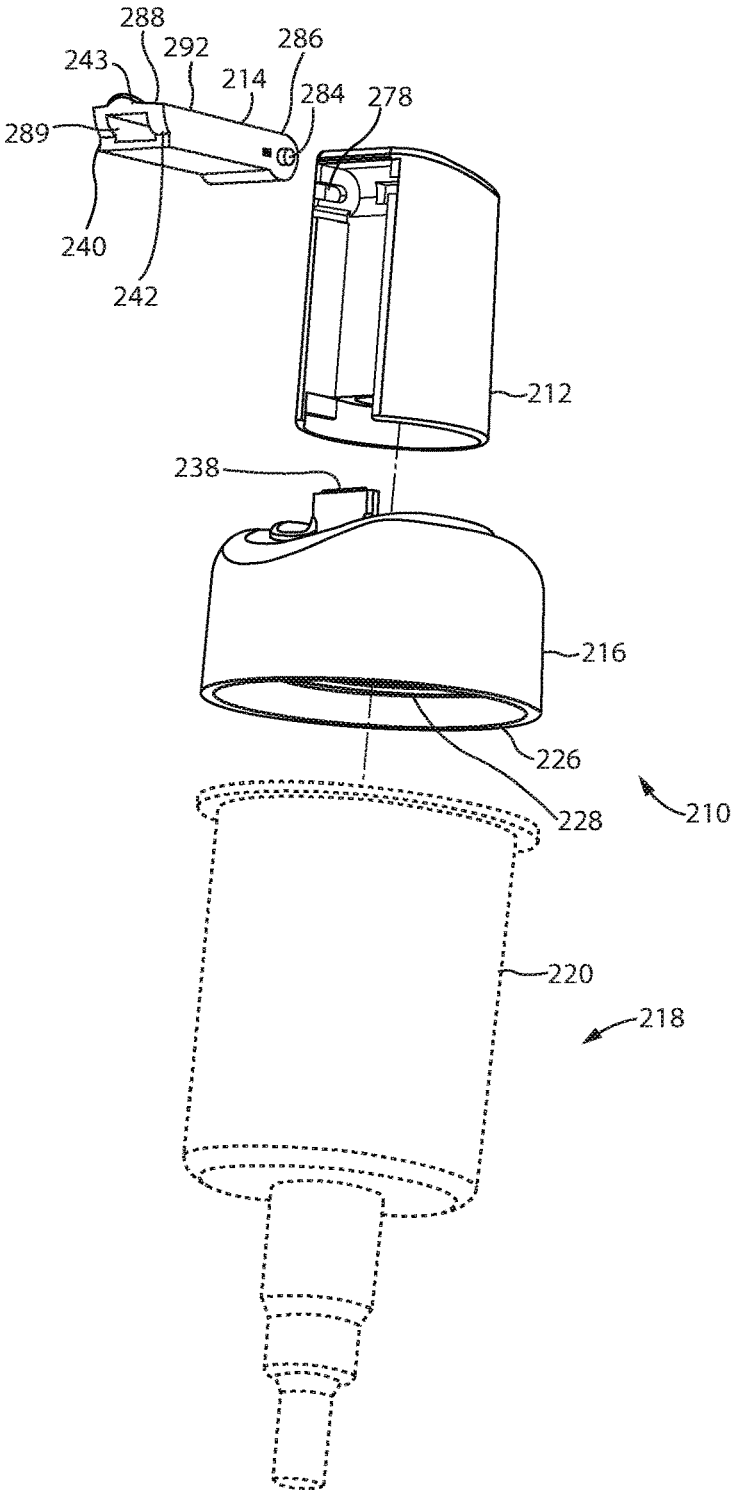
FIG. 8 is a perspective view of a second embodiment of the actuator assembly of the present invention having an alternative means for locking the nozzle to the closure, showing the nozzle in the open position.
Figure 9:
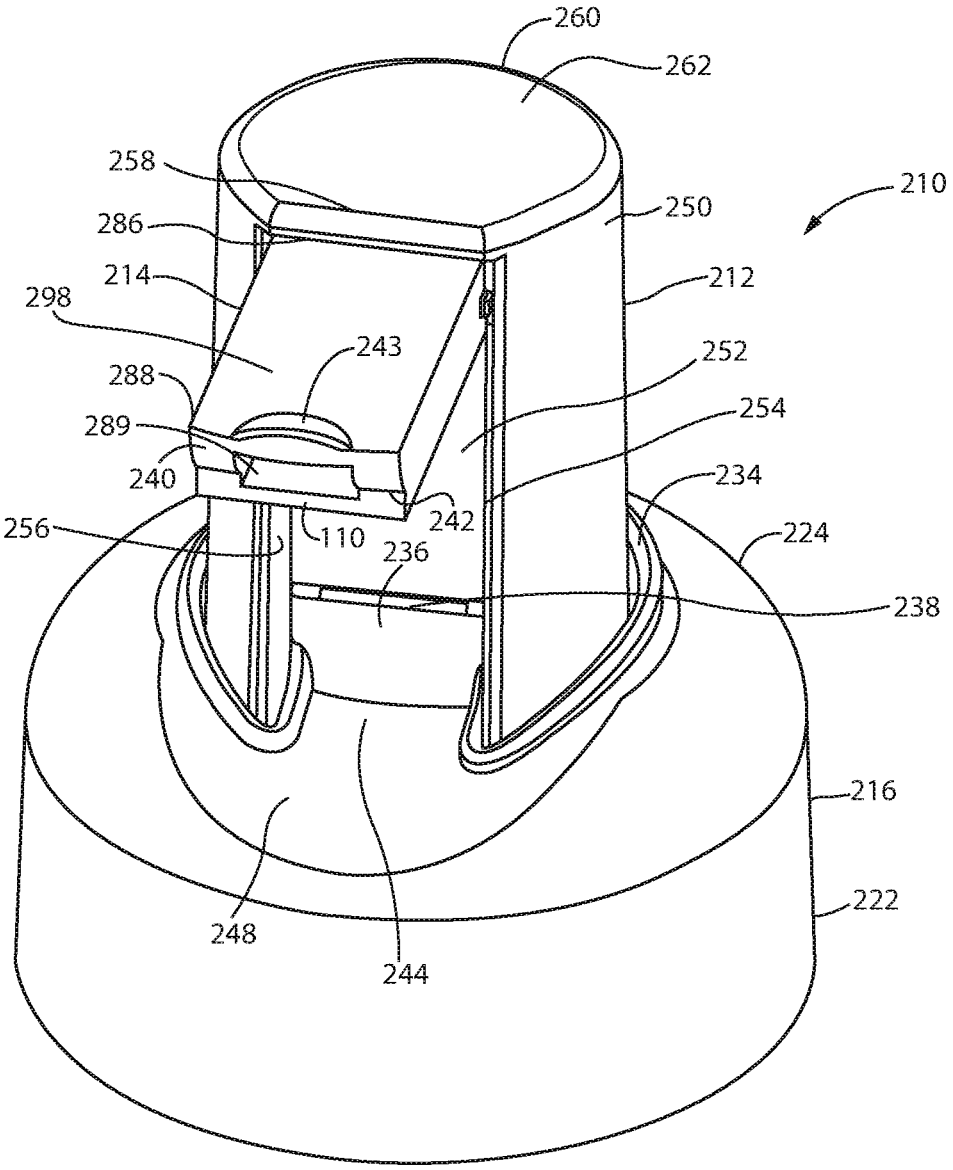
FIG. 9 is a perspective view of the second embodiment of the actuator assembly of FIG. 8, showing the nozzle in the closed position.
Figure 10:
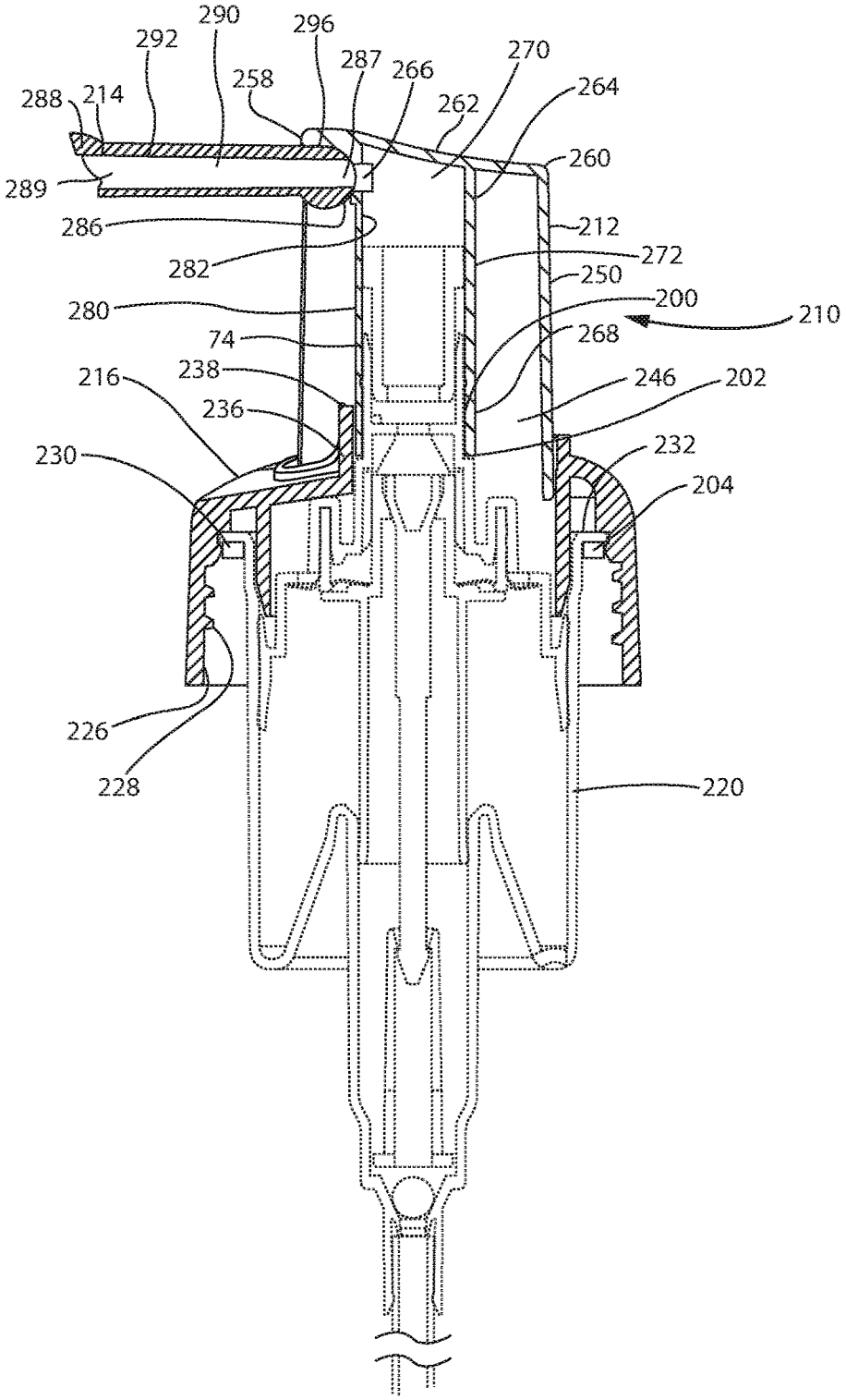
FIG. 10 is a cross-sectional view of the second embodiment of the actuator assembly of FIG. 8, showing the actuator in its normally extended position with tile nozzle in an unfolded position.

With continued reference to FIGS. 8-14, and particular reference to FIGS. 9 and 10, the pump closure 216 of the actuator assembly 210 is an injection molded part having a generally cylindrical body 222 and a generally dome shaped top 224. As shown in FIG. 9 and FIGS. 10-12, the pump closure 216 is hollow having a generally cylindrical interior wall 226, which features a plurality of screw threads 228. The plurality of screw threads 228 allow the pump closure 216 to be screwed onto a dispenser bottle (not shown). The pump closure includes a circular groove 230 which engages a circular lip 232 on tile pump body 220, i.e. the pump body 220 is attached to the closure 216 via a snap-fit between the circular lip 232 of the pump body 220 and the circular groove 230 of the closure 216.

With particular reference to FIG. 9, the generally dome shaped top 224 of the pump closure 216 includes a raised wall 234 having a generally oval shaped perimeter wherein the raised wall 234 includes a vertical plate portion 236. The vertical plate portion 236 includes a lock bead 238.

As best shown in FIGS. 9-12, a region of the dome shaped top 224 of the closure 216, interior of the raised wall 234, is cutaway to form a generally oval shaped opening 246 which corresponds to a generally, oval shaped exterior wall 250 of the actuator 212. Received within the opening 246 is the actuator 212. The generally dome shaped top 224 of the pump closure 216 further includes a recessed portion 248, which serves to allow a user to more easily release the folding nozzle 214, when the nozzle is in the folded position.

With continued reference to FIGS. 8-14, the actuator 212 is also an injection molded component with a hollow interior. The actuator 212 has an exterior wall 250 having a generally oval shaped perimeter with a recessed portion 252 at a front end. The recessed portion 252 is bounded at one end by a first engaging wall 254 and a second engaging wall 256 and by the vertical wall portion 236 which extends between first engaging wall 254 and the second engaging wall 256. The recessed portion 252 is configured to receive tile nozzle 212 when the nozzle is in tile folded position.

The actuator is configured such that it may be slidably received within the opening 246 of the pump closure 216, wherein the exterior wall 250 of the actuator slides within the raised wall 234 of the pump closure 216.

The actuator 212 also features a top portion 262 having a front edge portion 258 and a rear edge portion 260, where the top portion 262 slopes downwardly from the front edge portion 258 to the rear edge portion 260. (Best shown in FIGS. 10-12.) The sloping top portion 262 assists a user in depressing the actuator with a finger or thumb. Formed within the actuator 212 is a generally, centrally located vertical tube 264, having a wall 272. The wall 272 has a cylindrical interior surface 282. A portion of the wall 272 forms a face 280 of the recessed portion 252. Tile wall 272 is of sufficient thickness in this area such that the face 280 of the recessed portion 252 is a generally rectangular flat surface. The wall 272 is open at a lower inlet end 268, radially closed at an upper end 270, and has a rectangular opening 266 disposed adjacent the upper end 270 of the tube 264, wherein the rectangular opening 266 extends through the face 280 of the recessed portion 252 and the cylindrical interior surface 282 of the wall 272.

With reference to FIG. 8, the first side engagement wall 254 and the second side engagement wall 256 of the actuator 212 are each equipped with a dimple or small circular depression 278 adjacent the top edge 258 of the actuator 212. (See FIG. 1.) The dimples 278 engage with generally circular protrusions 284 located at an inlet end 286 of the nozzle 212. When assembled, the generally circular protrusions 284 of the nozzle 214 snap into the dimples 278 of the actuator 212. The inlet end 286 of the nozzle 214 is rounded so as so be rotatable within a matching rounded portion 296 of the actuator 214.

With reference to FIGS. 8-16, the nozzle 214 of the actuator assembly 210 has a hollow, generally rectangular body 292 having the inlet end 286 and an outlet end 288 and a flow passage 290 therebetween. The inlet end 286 has an inlet flow area 287 and tile outlet end 288 has an outlet flow area 289. In one embodiment, the flow passage 290 has a constant, rectangular cross-section and, in this case, the inlet flow area 287 and the outlet flow area 289 are the same. The flow passage 290 may also have a circular or square cross-section and may be of other cross-sectional shapes if desired. In alternative embodiments, the flow passage 290 of the nozzle 214 may have a varying cross-section such that, for example, the outlet area 289 is larger than the inlet area 287. FIGS. 17-19 depict such an alternative embodiment.

Figure 16:
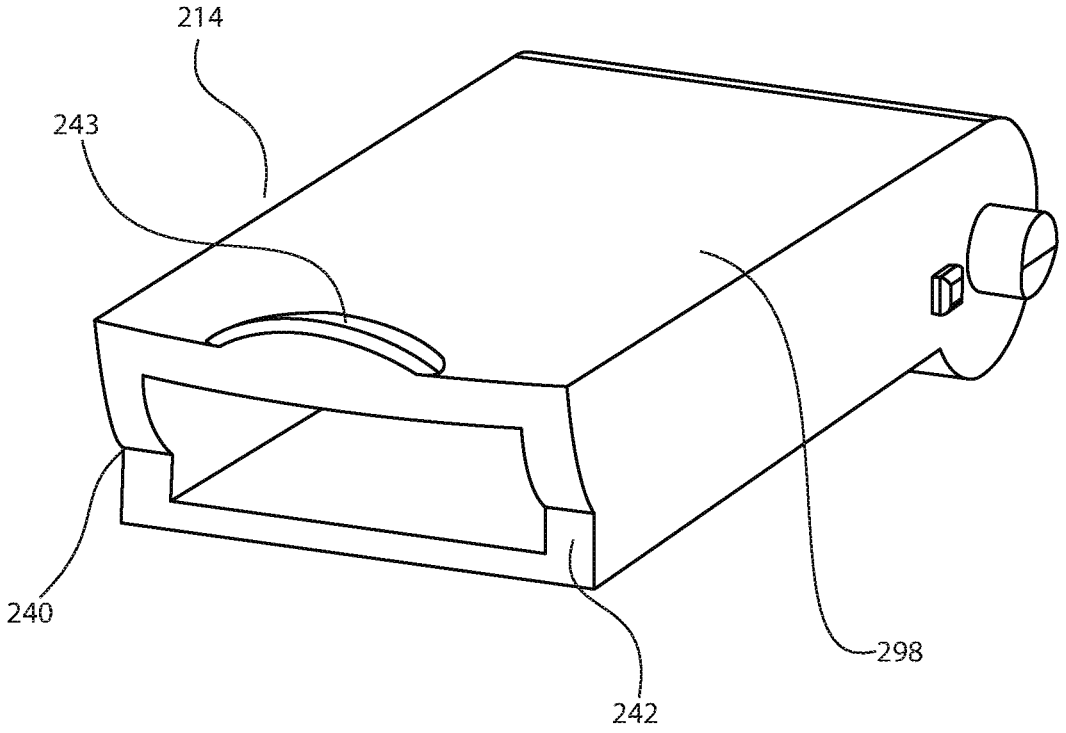
FIG. 16 is a front perspective view of the nozzle of the second embodiment of the actuator assembly of FIG. 8.

The hollow, generally rectangular body 292 of the nozzle 214 is equipped with left and right locking grooves 240 and 242 at its outlet end 288 (see FIG. 16). The nozzle 214 also features a centrally located raised semi-circular portion 243 at its outlet end 288. The raised semi-circular portion 243 is formed on the front face 298 of the nozzle 216 and is configured such that a user may slide his or her finger-tip under the raised semi-circular portion 243 to lift or pry the nozzle open from its closed position.

When the nozzle 214 is in the folded position, the left and right locking grooves 240 and 242 engage the lock bead 238 of the pump closure 216. When assembled to the actuator, the inlet end 286 of the nozzle 214 is in fluid communication with the rectangular opening 266 of the tube 264 of the actuator 212.

Figure 11:
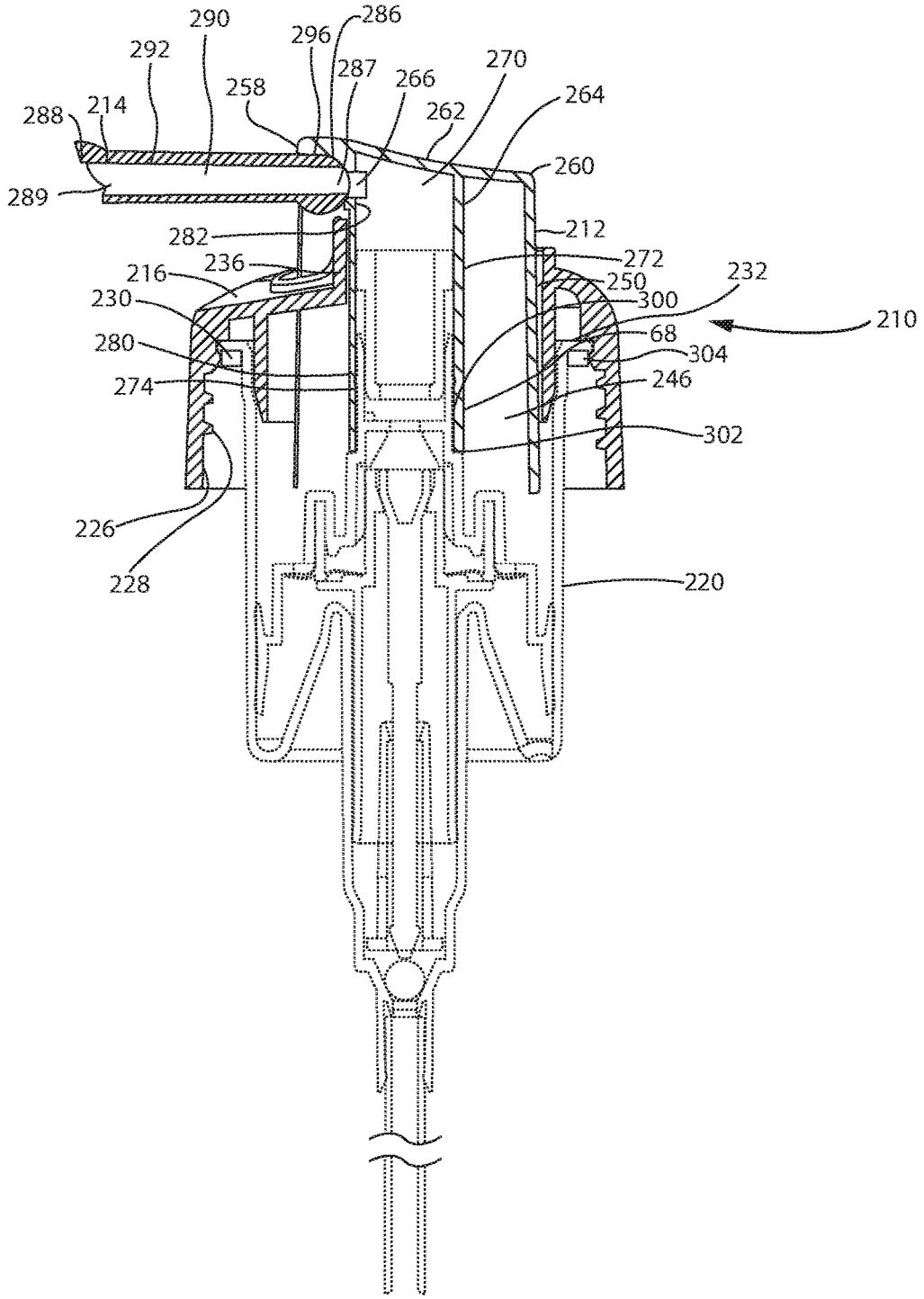
FIG. 11 is a cross-sectional view of the second embodiment of the actuator assembly of FIG. 8, showing the actuator in its fully depressed position with the nozzle in an unfolded position.
Figure 12:
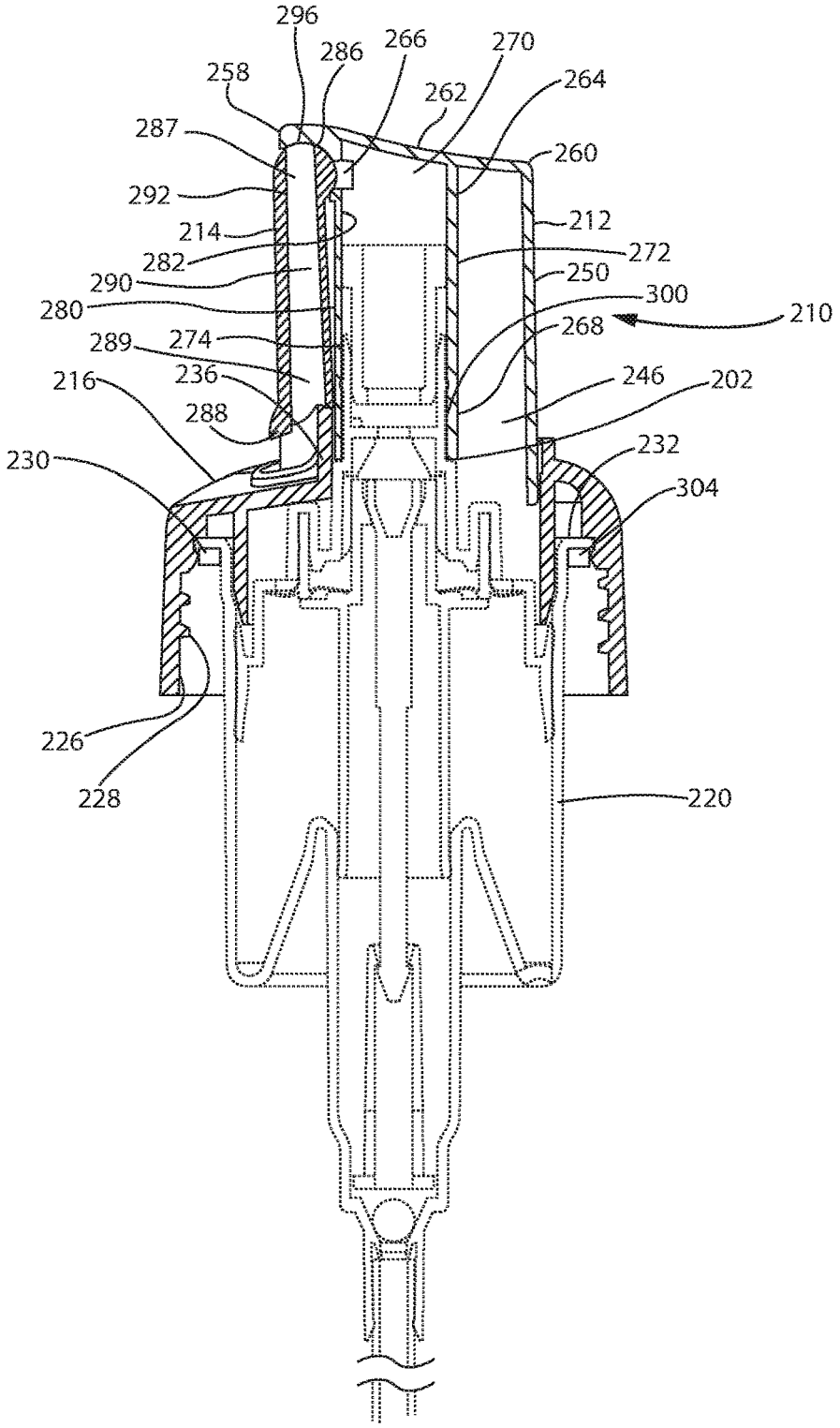
FIG. 12 is a cross-sectional view of the second embodiment of the actuator assembly of FIG. 8, showing the actuator in its normally extended position with the nozzle in a folded position.
Figure 13:
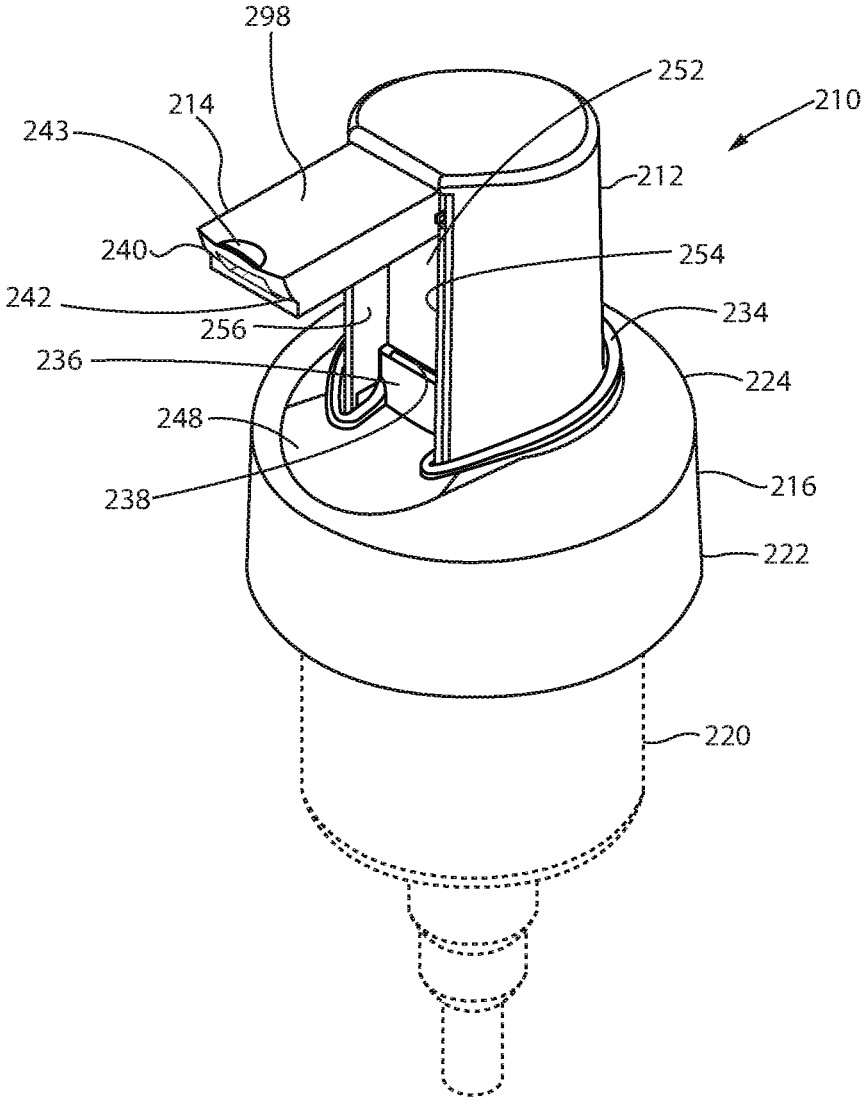
FIG. 13 is a front perspective view of the second embodiment of tile actuator assembly of FIG. 8, showing the actuator in its normally extended position with the nozzle in an unfolded position.
Figure 14:
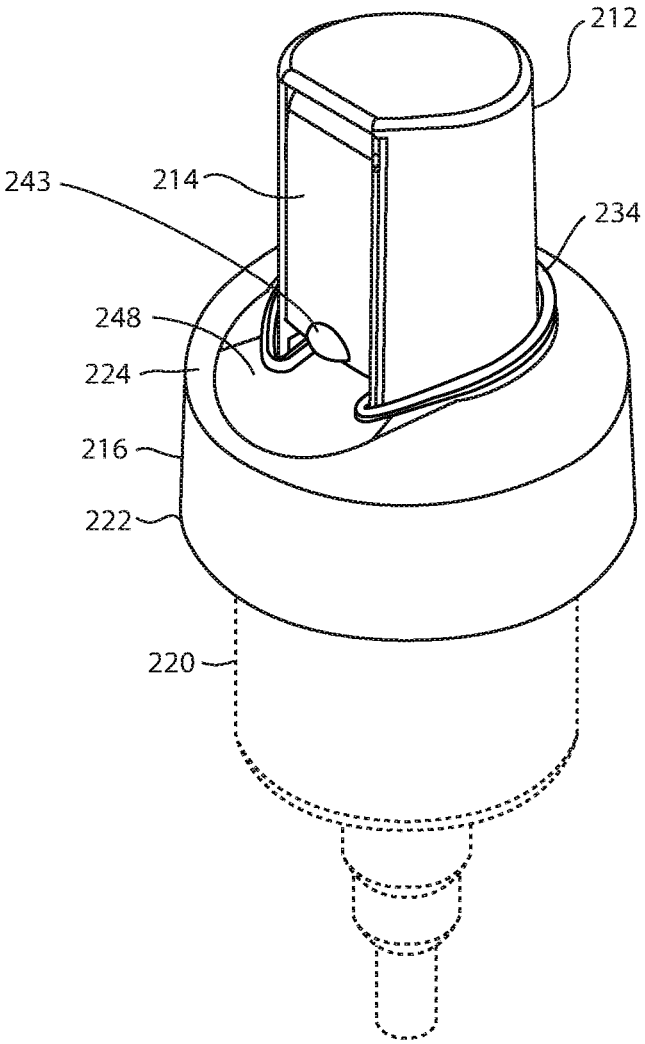
FIG. 14 is a front perspective view of the second embodiment of the actuator assembly of FIG. 8, showing the actuator in its normally extended position with the nozzle in a folded position.
Figure 15:
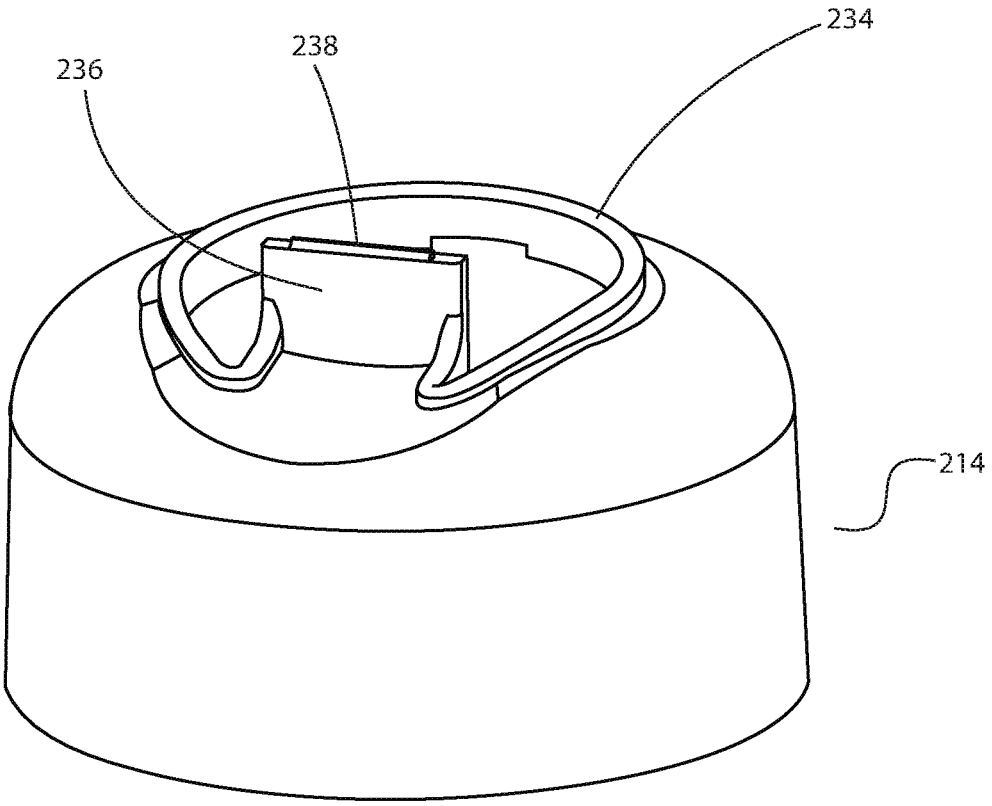
FIG. 15 is a front perspective view of the closure of the second embodiment of the actuator assembly of FIG. 8.

With reference to FIGS. 10-12, the actuator assembly 210 is assembled and installed on a hand operated foam pump as follows. First, the generally circular protrusions 284 of the nozzle 214 snap into the dimples 278 of the actuator 212. The inlet end 286 of the nozzle 214 is rounded and fits within the rounded portion 296 of the actuator 214. The nozzle is foldable between an open position, (see FIG. 10), and a closed position (see FIG. 12.) In the closed position, the left and right locking grooves 240 and 242 of the nozzle 216 engage the locking tab 238 of the pump closure 216.

Next, the actuator 212 is slid within the opening 246 of the pump closure 216. The actuator is configured such that the exterior wall 250 of the actuator slides within the raised wall 234 of the pump closure 216.

Subsequently, a stem 300 of a prior art hand operated pump 218 such as Pump No. F2 (http://www.albea-group.com/en/products/product-catalog/f2.html), manufactured by Albéa Group, 1,av du Général de Gaulle/ZAC des Barbanniers, Le Signac/92635 Gennevilliers Cedex, France, is press fit into the inlet end 268 of the centrally located tube 264 of the actuator 212. The stem 300 of the prior art hand operated pump 218 will typically include a shoulder 302. The stem 300 is pressed into the centrally located tube of the actuator 214 until the centrally located tube 264 bottom outs on the shoulder 302 of the stem 300. Next, the pump closure 216 is snap fit over the circular lip 232 on the pump body 220, such that the circular lip 232 engages the circular groove 230 of the pump closure 216 and thereby secures the pump closure 216 to tile pump body 220. Next, a gasket 304 is placed on tile underside of the circular lip 232 of the pump body 220 and the hand pump 218 is inserted into a dispenser bottle (not shown). The dispenser bottle will typically include external threads and is secured to the pump closure 216 by means of mating internal screw threads 228 formed on the pump closure 216.

Typically, the pump actuator assembly 210 of the present invention, with the nozzle 214 in the closed position, will be shipped installed on a hand pump 218 and the resulting assembly attached to a dispenser bottle (not shown). This configuration is shown in FIG. 12. It should be noted that with the nozzle 214 folded and locked into place, i.e. the left and right locking grooves 240 and 242 of the nozzle 214 have engaged the lock bead 238 of the pump closure 216, the actuator 212 cannot be depressed (see FIG. 12). This feature ensures against inadvertent operation of the hand pump during shipping.

During operation, the nozzle 214 is unfolded or opened. The actuator 212 may then be depressed to operate the hand pump 218. FIG. 11 shows the nozzle 212 in its fully depressed position. The amount of depression of the nozzle 212 is determined by tile travel limits of the hand pump 218. The nozzle 214 and tile centrally located tube 264 of the actuator 212 are in fluid communication and the centrally located tube 264 of the actuator 212 is in fluid communication with the hand pump 218 via the stem 300 of the hand pump which is in fluid communication with the contents of a dispenser bottle.

A second embodiment of an actuator assembly 210 comprising a pump closure 216, an actuator 212 and folding nozzle 214, has been presented. The new actuator assembly 210 eliminates the protrusion created by conventional nozzles or trigger handles of prior art actuators. The folding nozzle 214 of the new actuator assembly 210 helps to prevent the closure 216 of the actuator assembly 210 from loosening and unlocking during shipping. The folding nozzle 214 of the actuator assembly 210 of the present invention is configured so as to lock the actuator 212 in place and prevent: operation of a hand pump when the nozzle 214 is folded. The folding nozzle 214 also substantially reduces the likelihood of parts breakage during shipping of a filled product, again by eliminating trigger handles or other conventional nozzle types which protrude from the side of the actuator.

The ability of the actuator assembly 210 of the present invention to resist loosening and unlocking during shipping is further enhanced by providing an actuator assembly 210 that is free of any sharp edges, surface discontinuities or protrusions that may catch on other containers or packaging during shipping.

With reference to FIGS. 17-19, an alternative embodiment of the nozzle 314 is shown. The general principles of the configuration depicted in this embodiment may be used with both actuator assemblies 10 and 210. The nozzle 314 has an inlet end 386 and an outlet end 388. The inlet end 386 has an inlet flow area 387 and the outlet end 388 has an outlet flow area 389. In nozzle 314, the outlet flow area 389 is larger than the inlet flow area 287, i.e. the flow passage 390 of the nozzle 314 has a varying cross-section, in this case a tapered cross-section 392 as shown in FIG. 19. This configuration where tile outlet flow area is larger than the inlet flow area causes a pressure drop from the inlet to the outlet, which causes the foam to be dispensed at a reduced velocity at the outlet, than would be the case with a nozzle have a constant flow passage cross-section. Reducing the outlet velocity of the foam being dispensed is often desirable with certain types of foam because with certain foams a lower outlet velocity will improve the quality of the foam being dispensed.

With reference to FIGS. 1-19, the present invention is an actuator assembly 10, 210 for a hand operated pump comprising:

an actuator 12, 212 having a hollow body, a nozzle 14, 214 having an inlet end and an outlet end with a flow passage therebetween, and a closure 16, 216 having a hollow body;

wherein the nozzle 14, 214 is configured to attach to the actuator 12, 212 and fold between an open and a closed position;

wherein the actuator 12, 212 is configured with a generally oval shaped perimeter having a recessed, flat rectangular front surface for receipt of the nozzle 14, 214 when the nozzle is in the closed position, the actuator having a closed, sloped top end and an open bottom end;

wherein the actuator 12, 212 includes an internal, vertically oriented tube, the tube having a circular interior wall, a radially closed upper end and a radially open bottom end, wherein the tube further includes an opening in fluid communication with the flow passage of the nozzle 14, 214 at its inlet end;

wherein the closure 16, 216 includes a generally oval shaped opening configured to correspond to the perimeter of the generally oval shaped actuator 12, 212, wherein the actuator 12, 212 is slideably received within the generally oval shaped opening of the closure 16, 216;

means for preventing actuator 12, 212 depression when the nozzle 14, 214 is in the closed positon;

means for attaching the actuator 12, 212 to a fluid outlet of a hand operated pump;

means for attaching the closure 16, 216 to a hand operated pump; and means for retaining the nozzle 14, 214 in the closed position to prevent inadvertent opening of the nozzle.

In a first embodiment, the means for retaining the nozzle 14 in the closed position to prevent inadvertent opening of the nozzle 14 comprises a snap element or tab 40, 42 on the closure 16 wherein the snap tab 40, 42 engages the nozzle 14, when the nozzle 14is in the closed position.

The means for attaching the closure 16, 216 to a hand operated pump comprises a circular groove 30, 230 formed on an interior surface of the closure which engages a circular lip 32, 232 of a body of a hand pump.

In a first embodiment, the means for preventing actuator depression when the nozzle is in the closed position comprises an abutment surface or face 108, 110, 112 on the closure 16 which engages an abutment surface or face 114, 116, 118 on the nozzle, when the nozzle is in the closed position.

The means for attaching the actuator 12, 212 to a fluid outlet of the hand operated pump is a press fit between an inlet end of the vertically oriented tube 64, 264 of the actuator 12, 212 and an outlet end of a stem of the hand operated pump.

In a second embodiment, the means for holding the nozzle 214 in a closed position and for preventing actuator depression when the nozzle 214 is in the closed position, comprises a lock bead 238 on the closure 216 which engages a locking groove 240, 242 on the nozzle 216, when the nozzle 216 is in the closed position.

While the present invention has been described with regards to particular embodiments, it is recognized that additional variations of the present invention may be devised without departing from the inventive concept.

What is claimed is:

1. An actuator assembly for a hand operated pump comprising:

an actuator having a hollow body, a nozzle having an inlet end and an outlet end with a flow passage therebetween, and a closure having a hollow body;

wherein the nozzle is configured to attach to the actuator and fold between an open and a closed position;

wherein the actuator is configured with an oval shaped perimeter having a recessed, flat rectangular front surface for receipt of the nozzle when the nozzle is in the closed position, the actuator having a closed, sloped top end and an open bottom end;

wherein the actuator includes an internal, vertically oriented tube, the tube having a circular interior wall, a radially closed upper end and a radially open bottom end, wherein the tube further includes an opening in fluid communication with the flow passage of the nozzle at the nozzle's inlet end;

wherein the closure includes an oval shaped opening configured to correspond to the perimeter of the oval shaped actuator, wherein the actuator is slideably received within the generally oval shaped opening of the closure;

means for preventing actuator depression when the nozzle is in the closed positon;

means for attaching the actuator to a fluid outlet of a hand operated pump;

means for attaching the closure to a hand operated pump; and means for retaining the nozzle in the closed position to prevent inadvertent opening of the nozzle.

2. The actuator assembly for a hand operated pump of claim 1, wherein the means for retaining the nozzle in the closed position to prevent inadvertent opening of the nozzle, comprises a snap tab on the closure wherein the snap tab engages the nozzle, when the nozzle is in the closed position.

3. The actuator assembly for a hand operated pump of claim 1, wherein the means for attaching the closure to the hand operated pump comprises a circular groove formed on an interior surface of the closure which engages a circular lip of a body of the hand pump.

4. The actuator assembly for a hand operated pump of claim 1, wherein the means for preventing actuator depression when the nozzle is in the closed position comprises an abutment surface on the closure which engages an abutment surface on the nozzle, when the nozzle is in the closed position.

5. The actuator assembly for a hand operated pump of claim 1, wherein the oval shaped central opening of the closure is bordered by a retaining wall about the perimeter of the oval shaped central opening.

6. The actuator assembly for a hand operated pump of claim 1, wherein the inlet end of the nozzle has an inlet flow area and the outlet end of the nozzle has an outlet flow area, wherein the outlet flow area is larger than the inlet flow area.

7. The actuator assembly for a hand operated pump of claim 1, wherein the inlet end of the nozzle has an inlet flow area and the outlet end of the nozzle has an outlet flow area, wherein the outlet flow area is the same size as the inlet flow area.

8. The actuator assembly for a hand operated pump of claim 1, wherein the flow passage of the nozzle has a rectangular cross-section.

9. The actuator assembly for a hand operated pump of claim 1, wherein the nozzle has a raised semi-circular portion at the nozzle's outlet end, wherein the raised semi-circular portion functions as a finger tab to allow a user to pull the nozzle open from the nozzle's closed position.

10. The actuator assembly for a hand operated pump of claim 1, wherein the actuator, closure and nozzle are free of any sharp edges, surface discontinuities or protrusions that may catch on other containers or packaging during shipping, when the nozzle is in the folded condition.

11. An actuator assembly for a hand operated pump comprising:

an actuator having a hollow body, a nozzle having an inlet end and an outlet end with a flow passage therebetween, and a closure having a hollow body;

wherein the nozzle is configured to attach to the actuator and fold between an open and a closed position;

wherein the actuator is configured with a curved perimeter having a recessed, front surface for receipt of the nozzle when the nozzle is in the closed position, the actuator having a closed end and an open bottom end;

wherein the nozzle has a raised semi-circular portion at the nozzle's outlet end, wherein the raised semi-circular portion functions as a finger tab to allow a user to pull the nozzle open from the closed position;

wherein the actuator includes an internal, vertically oriented tube, the tube having a circular interior wall, a radially closed upper end and a radially open bottom end, wherein the tube further includes an opening in fluid communication with the flow passage of the nozzle at the nozzle's inlet end;

wherein the closure includes a curved opening configured to correspond to the curved opening of the actuator, wherein the actuator is slideably received within the curved opening of the closure;

means for preventing actuator depression when the nozzle is in the closed positon;

means for attaching the actuator to a fluid outlet of a hand operated pump;

means for attaching the closure to a hand operated pump; and means for retaining the nozzle in the closed position to prevent inadvertent opening of the nozzle.

12. The actuator assembly for a hand operated pump of claim 11, wherein the curved perimeter of the actuator is oval shaped and the curved opening of the closure is oval shaped.

13. The actuator assembly for a hand operated pump of claim 11, wherein the means for retaining the nozzle in the closed position to prevent inadvertent opening of the nozzle, comprises a lock bead on the closure which engages a groove on the nozzle, when the nozzle is in the closed position.

14. The actuator assembly for a hand operated pump of claim 11, wherein the means for attaching the closure to the hand operated pump comprises a circular groove formed on an interior surface of the closure which engages a circular lip of a body of the hand pump.

15. The actuator assembly for a hand operated pump of claim 11, wherein the means for preventing actuator depression when the nozzle is in the closed position comprises a lock bead on the closure which engages a groove on the nozzle, when the nozzle is in the closed position.

16. The actuator assembly for a hand operated pump of claim 12, wherein the oval shaped central opening of the closure is bordered by a retaining wall about the perimeter of the oval shaped central opening.

17. The actuator assembly for a hand operated pump of claim 11, wherein the inlet end of the nozzle has an inlet flow area and the outlet end of the nozzle has an outlet flow area, wherein the outlet flow area is larger than the inlet flow area.

18. The actuator assembly for a hand operated pump of claim 11, wherein the inlet end of the nozzle has an inlet flow area and the outlet end of the nozzle has an outlet flow area, wherein the outlet flow area is the same size as the inlet flow area.

19. The actuator assembly for a hand operated pump of claim 11, wherein the means for attaching the actuator to a fluid outlet of the hand operated pump is a press fit between an inlet end of the vertically oriented tube of the actuator and an outlet end of a stem of the hand operated pump.

20. The actuator assembly for a hand operated pump of claim 11, wherein the actuator, closure and nozzle are free of any sharp edges, surface discontinuities or protrusions that may catch on other containers or packaging during shipping, when the nozzle is in the folded condition.

* * * * *